US008432280B2

(12) United States Patent
Conklin et al.

(10) Patent No.: US 8,432,280 B2
(45) Date of Patent: Apr. 30, 2013

(54) SYSTEM AND METHOD FOR INDICATING A SWEPT MAIL SORT POCKET

(75) Inventors: Janice L. Conklin, Keller, TX (US); Michael O. Norris, Coleyville, TX (US); Dale E. Redford, Grand Prairie, TX (US); Susan L. Wertheim, Rowlett, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 343 days.

(21) Appl. No.: 12/878,119

(22) Filed: Sep. 9, 2010

(65) Prior Publication Data

US 2011/0062305 A1 Mar. 17, 2011

Related U.S. Application Data

(60) Provisional application No. 61/241,464, filed on Sep. 11, 2009.

(51) Int. Cl.
*G08B 21/00* (2006.01)

(52) U.S. Cl.
USPC ..... 340/540; 340/568.8; 340/555

(58) Field of Classification Search ..... 340/540, 340/500, 546, 547, 545.3–545.5, 555, 569, 340/568.8, 571, 572.1
See application file for complete search history.

(56) References Cited

U.S. PATENT DOCUMENTS

| | | | | |
|---|---|---|---|---|
| 4,388,994 | A * | 6/1983 | Suda et al. | 209/564 |
| 4,924,652 | A * | 5/1990 | Krasuski et al. | 53/55 |
| 5,290,225 | A * | 3/1994 | Younger | 493/188 |
| 5,417,414 | A * | 5/1995 | Belec et al. | 271/178 |
| 6,390,756 | B1 * | 5/2002 | Isaacs et al. | 414/281 |
| 2003/0006174 | A1 * | 1/2003 | Harres et al. | 209/584 |
| 2006/0124512 | A1 * | 6/2006 | Quine et al. | 209/584 |
| 2009/0097703 | A1 * | 4/2009 | Miller et al. | 382/101 |

FOREIGN PATENT DOCUMENTS

| | | |
|---|---|---|
| EP | 1872869 A2 | 1/2008 |
| EP | 2025417 A1 | 2/2009 |

* cited by examiner

*Primary Examiner* — Daniel Previl

(57) ABSTRACT

Systems and methods for indicating a swept pocket in a mail processing system. A mail processing system includes a plurality of pockets configured to receive and retain processed mail until the processed mail is removed by a user, and a movable paddle disposed in each pocket to retain the processed mail in the respective pocket. The user moves the paddle in order to remove processed mail from the respective pocket. The mail processing system includes a sensor connected to detect when the paddle in one of the plurality of pockets has been moved by the user, and an indicator associated with each pocket and connected to activate when the sensor detects that the paddle in the associated pocket has been moved by the user.

25 Claims, 3 Drawing Sheets

SYSTEM AND METHOD FOR INDICATING A SWEPT MAIL SORT POCKET

CROSS-REFERENCE TO OTHER APPLICATION

This application claims the benefit of the filing date of U.S. Provisional Patent Application 61/241,464, filed Sep. 11, 2009, which is hereby incorporated by reference.

TECHNICAL FIELD

The present disclosure is directed, in general, to systems and methods for mail processing.

BACKGROUND OF THE DISCLOSURE

Accuracy can be important in mail sorting and handling processes, and systems to improve accuracy are desirable.

SUMMARY OF THE DISCLOSURE

Various disclosed embodiments include systems and methods for indicating a swept pocket in a mail processing system. In some embodiments, a mail processing system includes a plurality of pockets configured to receive and retain processed mail until the processed mail is removed by a user, and a movable paddle disposed in each pocket to retain the processed mail in the respective pocket. The user moves the paddle in order to remove processed mail from the respective pocket. The mail processing system includes a sensor connected to detect when the paddle in one of the plurality of pockets has been moved by the user, and an indicator associated with each pocket and connected to activate when the sensor detects that the paddle in the associated pocket has been moved by the user.

In some embodiments, a mail processing system includes a plurality of pockets configured to receive and retain processed mail until the processed mail is removed by a user and a movable paddle disposed in each pocket to retain the processed mail in the respective pocket. The user moves the paddle in order to remove processed mail from the respective pocket. The mail processing system includes an apparatus connected to at least one paddle and configured to activate an indicator when the user moves the at least one paddle in order to remove processed mail from the respective pocket.

Some embodiments include a method for indicating a swept pocket in a mail processing system. The method includes retaining mail using a movable paddle in one of a plurality of pockets in a mail processing system and detecting that the paddle has been moved by a user to sweep mail from the pocket. The method also includes, in response to the detecting, activating an indicator corresponding to the one of the plurality of pockets.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
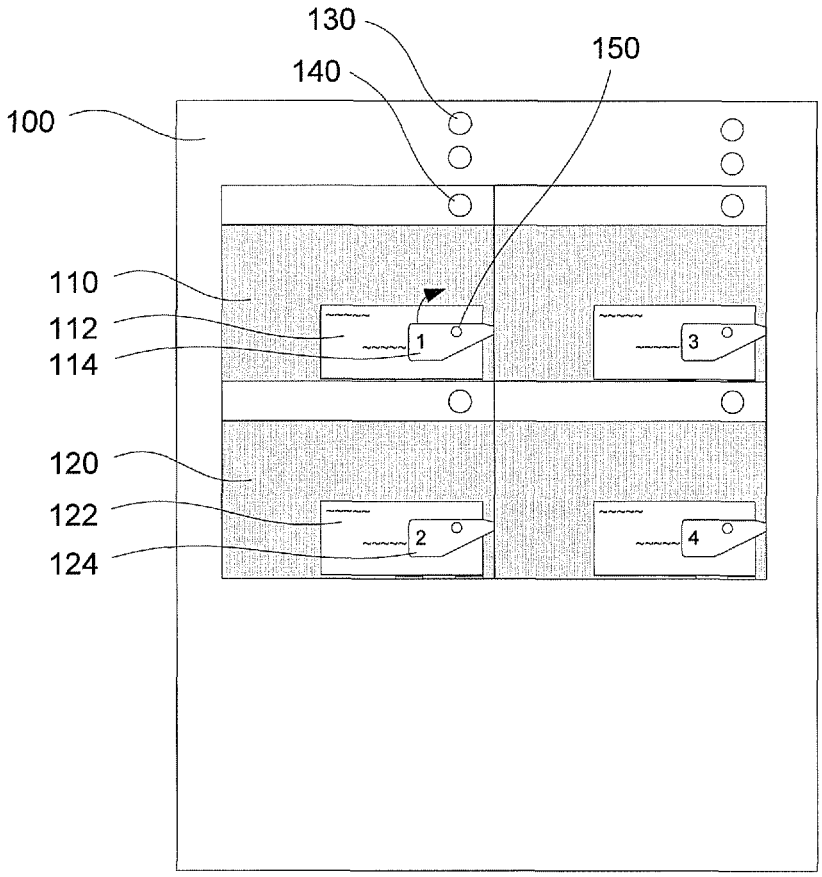
FIG. 1 depicts a portion of a mail processing system in accordance with disclosed embodiments.

FIGS. 1 through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

A common type of mail sorting machine uses a transport system that delivers mail to two or more pockets according to a sort plan. Mail is sorted in a vertical orientation in the pocket and a paddle is used to control the stack of mail. The paddle is in a vertical orientation and moves along a rail as the mail accumulates in the pocket. The paddle is forced against the stack by a spring or counterweight system.

As the pocket is filled during a sorting operation, or after completion of the operation, an operator removes mail from the pocket and places it in a tray that was previously designated for mail from that pocket. In this manner, the mail that was sorted according to the sort plan is now in trays that correspond to the outputs specified in the sort plan.

It has been noted that a common cause of mail being placed in the wrong tray occurs when the operator is distracted during the act of moving the mail from the pocket to the tray. An example is the operator has just removed the mail and a nearby fork truck honks a horn. The operator is briefly distracted and then places the mail in an adjacent tray rather than the tray that corresponds to the pocket from which the mail was removed.

Placing the mail in the wrong tray can have serious consequences. It is not unusual for the operator to remove six inches or more stacked mail and this can correspond to over 100 letters. If the mail being sorted is destined for another mail processing facility these letters may be placed on the wrong transport (truck or airplane) and sent across the country to the wrong facility. This not only incurs significant expense to re-sort and transport the mall to the correct facility but it also ensures the mail will not meet the committed delivery service as promised by the postal delivery system.

When the operator removes the mail from the pocket the paddle is raised to give access to the stack of mail. The paddle is typically moved to the front of the stack, end closest to the sorter, and inserted into the stack. The operator then removes the mail from the paddle to the end of the stack.

Various embodiments disclosed herein can sense the movement of the paddle and activate a light or other indicator corresponding to the pocket being swept to indicate for a short time which pocket has been swept. For example, an indicator light or light emitting diode (LED) can flash for several seconds. If the operator is distracted during the movement of the mail a brief glance back to the system will confirm the pocket from which the mail originated and aid in correct correlation of the mail to the corresponding tray.

On a system such as the Delivery Bar Code Sorter (DBCS) in wide usage by the United States Postal Service (USPS) a light corresponding to each pocket can be used, such as on an overhead panel on each stacker modules. The DBCS has pockets on four levels and four corresponding lights can be arranged in a vertical line on the panel above each column of four pockets. In a system in accordance with disclosed embodiments, a sensor may be attached or connected to each paddle to detect the rotation of the paddle performed by the operator when sweeping the pocket.

The system receives the sensor input and activates the indicator corresponding to the pocket being swept for some period of time, such as 5 to 20 seconds. If the operator becomes distracted or simply forgets the pocket association for the mail that has just been removed from the pocket, the indicator indicates the correct sort location and the operator can then re-confirm the associated tray.

Some sorting systems have indicators built into the pocket, typically near the output face. In this case, the paddle rotation is sensed and the system causes this light to flash as described above. In general, an indicator at the pocket is preferred to an indicator in a panel above the pockets because the operator refers back to the actual sort location.

The figures described below are not to scale or in proper dimension, but are simplified for illustrative purposes.

FIG. 1 depicts a portion of a mail processing system such as a DBCS, in accordance with disclosed embodiments, as an example of the mail processing equipment in which an embodiment can be implemented.

This simplified drawing shows a pocket array of a DBCS 100, showing multiple sort pockets, indicators, and paddle triggers. The remainder of the structure and operation of DBCS is conventional, and so is not illustrated here. In typical implementations, there will be many more sort pockets, typically arranged in a series of columns of four pockets each, but only four are shown in this example for clarity.

This simplified array shows four sort pockets, including sort pockets 110 and 120, which receive sorted mail pieces 112 and 122 respectively. The sorted mail pieces are stacked behind and retained by paddles 114 and 124, respectively, as they are sorted by the DBCS. The operator periodically "sweeps" the pocket by rotating the paddle away from the mail pieces, as illustrated by the arrow on paddle 114, and removing the stacked mail pieces.

Various embodiments herein include sensors (not shown in this figure) to detect when a paddle has been raised, and an indicators such as a lamp or LED corresponding to that pocket and paddle that indicates which pocket was most recently swept. Different embodiments describe different potential locations for the indicator.

For example, in the context of FIG. 1, a sensor detects when paddle 114 is rotated or moved in order to sweep mail pieces 112 from pocket 110. When this occurs, the indicator is activated for a short time as described herein.

In some embodiments, the indicator can be located above a column of pockets, with one indicator corresponding to each pocket below it. As shown, indicator 130 is above pockets 110 and 120, and as the topmost indicator, corresponds to the topmost pocket below it. When indicator 130 is activated, it indicates that pocket 110 was most recently swept. That is, in these embodiments, the indicator is located above a column of pockets in a position corresponding to the position of the associated pocket in the column.

In some embodiments, the indicator can be located directly adjacent to each pocket. As shown, indicator 140 is located directly above pocket 110. When indicator 140 is activated, it indicates that pocket 110 was most recently swept.

In some embodiments, the indicator can be located directly on the individual paddles. As shown, indicator 150 is located directly on paddle 114. When indicator 150 is activated, it indicates that pocket 110 was most recently swept.

Of course, the various indicator positions illustrated in FIG. 1 are not intended to be limiting, but merely illustrate possible locations for indicators as described herein. Further, while various indicators 130, 140, and 150 are shown here, these are preferably alternative indicators, and only one indicator is provided for each sort pocket.

One disclosed embodiment uses a self-contained sensor and indicator device attached directly to the paddle. The advantage of such a device is that it does not require the addition of an input to the system electronics for the sensor and it will work on systems that have no pre-existing pocket indicator. It also puts the indicator at the pocket for systems like DBCS rather than using an indicator on an overhead panel.

Figure 2:
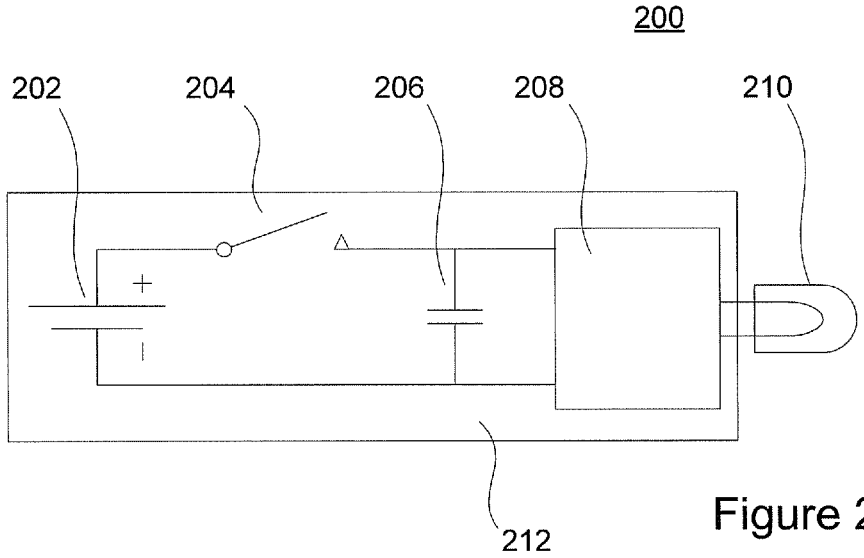
FIG. 2 depicts an apparatus that can be used as an indicator circuit and assembly in accordance with disclosed embodiments.

FIG. 2 depicts an apparatus 200 that can be used as such an indicator circuit and assembly.

In this figure, a battery 202 is connected to indicator control 208, which controls the timing, flashing, and other behavior of lamp 210. Lamp 210 can be any suitable light source, such as an incandescent lamp, and is preferably an LED. The sensor, as described herein, can be implemented as a switch 204 that connects the battery 202 to indicator control 208. Capacitor 206 is connected in parallel with the battery 202 and indicator control 208. The apparatus 200 can include a housing 212, so long as lamp 210 is visible to the user.

In the example above, the switch 204 can be, for example, a roller ball tilt switch such as manufactured by SoLiCo or NKK Switches. In switches of this type, when the switch is tilted relative to earth, such as when paddle 114 is rotated, gravity causes a conductive ball to roll into the contacts and the circuit is completed. Indicator control 208 can be implemented, for example, using a MICROCHIP PIC12F635-I/P microcontroller or a National Semiconductor LM3909 LED Flasher/Oscillator with additional control capacitors as specified for that device, or using other similar devices.

According to disclosed embodiments, various characteristics of the indicator control can be programmed or otherwise customized. For example, the indicator control can customize the indicator delay as to the period of time after the paddle has been moved before activating the light or LED, the indicator activation time as to the duration that the indicator flashes indicating the paddle has been moved by the user, how long after the paddle is moved before the LED is activated, how long the LED is flashed, at what rate the LED is flashed, and in other ways.

When the circuit is completed, the capacitor 206 is charged by the battery 202 and the indicator control 208 is activated. Indicator control 208 receives an input from switch 204, which in this case is the input voltage. Indicator control 208 causes the lamp 210 to flash at an easily recognizable rate such as twice per second. Once the paddle 114 is moved back to the normal position the ball moves away from the switch contacts and the circuit to the battery 202 is disconnected. The charge in the capacitor 206 is sufficient to continue power to the indicator control 208 and the lamp 208 is flashed for sufficient time to provide feedback to the user. When the charge in the capacitor 206 is depleted the circuit becomes dormant and no power is drawn from the battery until the paddle is moved again.

There are other types of switches that can be used and one skilled in the art will recognize that the apparatus 200 can be implemented with a variety of different components. Activations in a typical postal environment would be approximately seven activations per day for a typical pocket on a mail sorting system. This is based on a typical machine having 200 pockets and running 120,000 pieces per day. Assuming each sweep removes an average of 100 pieces, there will be 7 sweeps per day, per pocket, on average.

Lithium coin cell batteries often have shelf lives of ten years and in this application even a low end 70 mah battery such as a CR1620 can be used as battery 202 and could last over two years in normal operation.

As described above with regard to FIG. 1, in some embodiments, the indicator 150 is located directly on paddle 114. One method of mounting the apparatus on the paddle is to permanently affix a housing 212 to the paddle and install the lamp 210 so that it is visible, to the user, on the paddle. The switch 204 may be permanently affixed to the housing 212 as a typical life for this type switch is over 100,000 activations and this translates to a life of over 30 years.

If the housing 212 is designed so a simple tool such as a flat-blade screwdriver is required to remove the housing 212 paddle 114, theft would be discouraged but the apparatus 200 could be easily replaced over time. The apparatus 200 itself, in some embodiments, is approximately the diameter of a U.S. quarter and about twice as thick.

Figure 3:
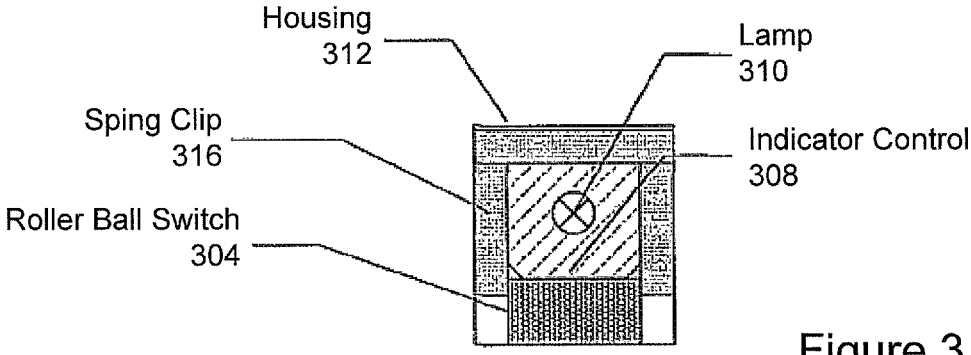
FIG. 3 shows an example of a paddle-mounted indicator apparatus in accordance with disclosed embodiments.

FIG. 3 shows an example of a paddle-mounted indicator apparatus, in accordance with disclosed embodiments, that can be mounted on a paddle 114 for example.

In this example, housing 312 is shown, including a spring clip 314 for attaching to a paddle. The housing 312 houses roller ball switch 304, indicator control 308, and lamp 310. Lamp 310 is positioned to be visible to the user/operator of the DBCS, such as by extending through a hole in the paddle, being visible through a hole in the paddle, or extending over an edge of the paddle, in implementations where the apparatus is mounted on the backside of the paddle. In other implementations, the apparatus can be mounted on the front side of the paddle, and the lamp 310 can be positioned to be visible to the user/operator of the DBCS, such as by extending through a hole in the housing, being visible through a hole in the paddle, by having the housing itself be translucent or transparent so the activated lamp is visible through the housing, or otherwise.

In other embodiments, instead of spring clip 314, the housing 312 can be mounted to a paddle shaft by sliding the housing onto the shaft and securing it in place with a screw. The housing can include molded grooves or other physical features that conform to the shaft or paddle and are designed to secure the placement of the housing 312.

The implementation of FIG. 3 is a self-contained apparatus that can be temporarily or permanently attached to a paddle in a mail sort pocket of mail processing equipment to detect and indicate which paddle has been moved. As disclosed above, however, other implementations can be integral to the mail processing equipment, where the mail processing system provides power, eliminating the need for a battery. In other implementations, the indicator lamps can be placed elsewhere, as indicated above, and a single controller can be connected to receive inputs from multiple sensor switches and control the activation of multiple indicators.

Other variations on the mounting may be considered. All of the components except the battery could be permanently mounted as an example. In other embodiments, the entire holder, battery, flasher and switch, or any of those components, can be disposable. One skilled in the art can make decisions based upon component life, price and reliability as to which elements should be considered permanent and which should be disposable, and such variations, unless specifically excluded, are intended to encompassed in the scope of the claims below.

Figure 4:
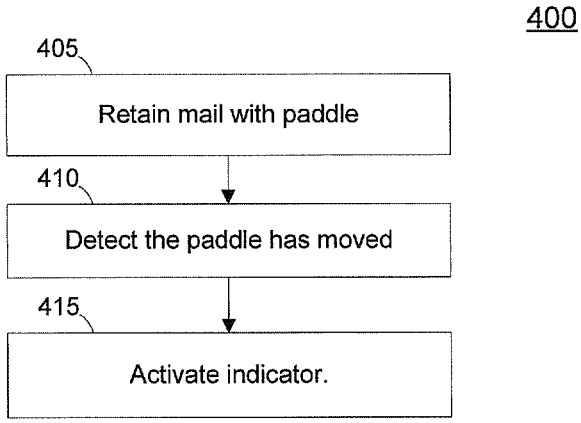
FIG. 4 depicts a flowchart of a process in accordance with disclosed embodiments.

FIG. 4 depicts a flowchart of a process in accordance with disclosed embodiments.

A mail processing system retains mail in a plurality of locations using a movable paddle in each location (step 405). In various embodiments, the mail processing system can be a DBCS.

The mail processing system detects that a movable paddle has been moved in order to sweep the retained mail (step 410). As described above, in some embodiments, this is performed using a roller ball tilt switch connected to an indicator control.

In response to the detection, the mail processing system or indicator control activates an indicator to indicate the pocket that has been swept (step 415). In some embodiments, this can include flashing an indicator lamp, such as an LED, for a limited period of time. The indicator is positioned such that it can be easily associated by a user with the swept pocket, as described in more detail above.

Below sequence describes the basic operation states of a specific non-limiting example of an indicator as disclosed.

A) Paddle Down in Horizontal Position (mail actively being sorted to pocket)

LED is OFF

B) Paddle raised to Vertical Position (begin sweep of mail from pocket)

LED is OFF

C) Paddle moved back to Horizontal Position (pocket has been swept, mail still being sorted to pocket)

Delay of 3 seconds (operator is loading mail cart, not looking at indicator)

LED blinks 10 times (each blink cycle=1 sec for total of 10 seconds)

LED goes OFF (Return to state A)

In some embodiments, if the paddle is returned to the vertical position before the end of the 10 sec blink cycle, the indicator is immediately turned OFF. This is designed to conserve battery power. If the paddle remains in any one position (vertical or horizontal) for more than 2-3 seconds, the indicator goes to "sleep". Any subsequent movement of the paddle will "wake up" the indicator. The "sleep mode" is a power savings mechanism and does not negatively affect normal operation.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto. Various embodiments can include a machine-readable medium encoded with instructions that, when executed, cause one or more data processing systems to perform processes as described herein.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A mail processing system, comprising:

a plurality of pockets configured to receive and retain processed mail until the processed mail is removed by a user;

a movable paddle disposed in each pocket to retain the processed mail in the respective pocket, wherein the user moves the paddle in order to remove processed mail from the respective pocket;

a sensor connected to detect when the paddle in one of the plurality of pockets has been moved by the user; and an indicator associated with each pocket and connected to activate when the sensor detects that the paddle in the associated pocket has been moved by the user.

2. The mail processing system of claim 1, further comprising an indicator control connected to receive input from the sensor and activate the indicator.

3. The mail processing system of claim 1, wherein the indicator is located adjacent to the associated pocket.

4. The mail processing system of claim 1, wherein the indicator is located above a column of pockets in a position corresponding to the position of the associated pocket in the column.

5. The mail processing system of claim 1, wherein the indicator is located on the paddle.

6. The mail processing system of claim 1, wherein the sensor is a roller ball tilt switch.

7. The mail processing system of claim 1, wherein the indicator is a lamp that lights when activated.

8. The mail processing system of claim 1, wherein the indicator is a light emitting diode that lights when activated.

9. The mail processing system of claim 1, wherein the indicator flashes light when activated.

10. The mail processing system of claim 1, wherein the indicator activates for a limited period of time when the sensor detects that the paddle in the associated pocket has been moved by the user.

11. The mail processing system of claim 1, wherein indicator is activated after a programmable delay from when the paddle is moved by the user.

12. The mail processing system of claim 1, wherein the indicator is activated for a programmable duration.

13. The mail processing system of claim 1, wherein the indicator, when activated, flashes at a programmable flash rate.

14. The mail processing system of claim 1, wherein the indicator activates for 5 to 20 seconds when the sensor detects that the paddle in the associated pocket has been moved by the user.

15. A mail processing system, comprising:

a plurality of pockets configured to receive and retain processed mail until the processed mail is removed by a user;

a movable paddle disposed in each pocket to retain the processed mail in the respective pocket, wherein the user moves the paddle in order to remove processed mail from the respective pocket;

an apparatus connected to at least one paddle and configured to activate an indicator when the user moves the at least one paddle in order to remove processed mail from the respective pocket.

16. The mail processing system of claim 15, wherein the apparatus is mounted on the at least one paddle so that the indicator is visible to the user.

17. The mail processing system of claim 15, wherein the apparatus includes a sensor connected to detect when the at least one paddle has been moved by the user and an indicator control connected to receive input from the sensor and activate the indicator based on the input.

18. The mail processing system of claim 17, wherein the indicator also includes a capacitor connected to power the indicator control and the indicator and a battery connected to charge the capacitor.

19. The mail processing system of claim 17, wherein the sensor is a roller ball tilt switch.

20. The mail processing system of claim 17, wherein the indicator control is configured to flash the indicator for a limited time after receiving the input.

21. The mail processing system of claim 15, wherein the indicator is a light emitting diode that lights when activated.

22. A method for indicating a swept pocket in a mail processing system, comprising:

retaining mail using a movable paddle in one of a plurality of pockets in a mail processing system;

detecting that the paddle has been moved by a user to sweep mail from the pocket; and in response to the detecting, activating an indicator corresponding to the one of the plurality of pockets.

23. The method of claim 22, wherein each of the plurality of pockets has a respective paddle a respective indicator that is activated when the respective paddle is moved by a user.

24. The method of claim 22, wherein the indicator is positioned so that it indicates, to the user, the pocket that has been most recently swept.

25. An apparatus, comprising:

a housing adapted to be attached to a paddle of a mail processing system;

a sensor in the housing and connected to detect when the paddle has been moved by a user;

an indicator control connected to receive input from the sensor; and an indicator that is visible to the user and connected to be activated by the indicator based on the input.

* * * * *